US007271332B2

(12) United States Patent
Clark

(10) Patent No.: US 7,271,332 B2
(45) Date of Patent: Sep. 18, 2007

(54) AMPLIFICATION OF ACOUSTIC GUITARS

(75) Inventor: Bradley Roy Clark, Bayswater (AU)

(73) Assignee: Australian Native Musical Instruments Pty. Ltd., Victoria (AU)

( * ) Notice: Subject to any disclaimer, the term of this patent is extended or adjusted under 35 U.S.C. 154(b) by 0 days.

(21) Appl. No.: 10/561,765

(22) PCT Filed: Jun. 28, 2004

(86) PCT No.: PCT/AU2004/000858

§ 371 (c)(1),
(2), (4) Date: May 2, 2006

(87) PCT Pub. No.: WO2005/001811

PCT Pub. Date: Jan. 6, 2005

(65) Prior Publication Data

US 2007/0006718 A1 Jan. 11, 2007

(30) Foreign Application Priority Data

Jun. 27, 2003 (AU) ..... 2003903326

(51) Int. Cl.
*G10H 1/12* (2006.01)
*G10H 1/08* (2006.01)

(52) U.S. Cl. ..... 84/736; 84/697

(58) Field of Classification Search ..... 84/625, 84/660, 697, 723–743, DIG. 24; 323/353; 338/130, 132; 381/98–103, 118
See application file for complete search history.

(56) References Cited

U.S. PATENT DOCUMENTS 3,733,425 A * 5/1973 Chaki ..... 84/731
4,251,688 A * 2/1981 Furner ..... 381/18
4,501,186 A 2/1985 Ikuma
4,913,024 A * 4/1990 Carriveau ..... 84/726
4,989,491 A * 2/1991 Baggs ..... 84/723
5,557,058 A * 9/1996 Lace ..... 84/735
5,723,804 A 3/1998 Replogle (Continued)

OTHER PUBLICATIONS

B-Band web site http://www.b-band.com/product_a4.2.shtml & http://web.archive.org/web/20030701152423/www.b-band.com/product_a4.shtml, Jun. 24, 2003.

*Primary Examiner*—Lincoln Donovan
*Assistant Examiner*—Andrew Millikin
(74) *Attorney, Agent, or Firm*—Patterson, Thuente, Skaar & Christensen, P.A.

(57) ABSTRACT

A device for mixing the outputs of two sensors. The device includes a first input for receiving a signal from at least one first sensor, a second input for receiving a signal from at least one second sensor, a low pass filter for passing signal components of the first input signal below a first frequency, a high pass filter for passing signal components of the second input signal above a second frequency and a mixing circuit for combining the signals passed by the low pass filter and the high pass filter to form a combined output signal. The mixing device may be incorporated into a pre-amplifier for use with an electrified acoustic guitar, or other acoustic stringed instrument, having an under saddle sensor and a second sensor attached to a body portion of the guitar, such as the soundboard. In this way, lower frequencies are taken from the under saddle sensor and higher frequencies are taken from the body/soundboard sensor.

18 Claims, 3 Drawing Sheets

U.S. PATENT DOCUMENTS 5,817,966 A * 10/1998 Fishman ..... 84/731
6,111,186 A 8/2000 Krozack et al.
6,627,808 B1 9/2003 Coats et al.

* cited by examiner

AMPLIFICATION OF ACOUSTIC GUITARS

RELATED APPLICATION

This application claims priority to PCT Application No. PCT/AU2004/000858 filed Jun. 28, 2004, and Australian Patent Application No. 2003903326 filed Jun. 27, 2003.

FIELD OF THE INVENTION

The present invention relates generally to electronic amplification of acoustic instruments, and in particular to the amplification or recording of string instruments such as acoustic guitars. It should be understood however that the invention is not restricted to this example application and is intended for broader application and use.

BACKGROUND OF THE INVENTION

An acoustic guitar includes a body or resonant cavity having (i) a front panel, often referred to as the face or soundboard, (ii) a back panel and (iii) side walls extending between the soundboard and back panel. A neck, carrying a finger board, projects from the body and strings are stretched between a "nut" at the head end of the finger board and a "saddle" supported by a bridge attached to the soundboard of the instrument. The strings oscillate, when plucked or strummed, between the nut and the saddle.

In an acoustic guitar, these oscillations are transmitted mechanically as vibrations to the soundboard of the instrument, and hence to the resonant cavity, including the back panel and side walls. These vibrations are then transmitted to the surrounding air, predominately by the soundboard of the instrument but also by the back panel and side walls, and to some extent also by the strings directly.

The tonal qualities of an acoustic guitar are thus determined by a combination of all of these factors. Reproduction or amplification of an acoustic guitar therefore presents particular difficulties because of the complex interactions between these factors.

In the past, acoustic guitars have generally been recorded or amplified using piezoelectric sensors situated between the bridge and the saddle of the instrument, i.e. immediately under the strings. Such systems will be referred to herein as "under saddle systems". The response achieved by under saddle systems is predominately the reproduction of vibrations of the strings according to how they are stretched between the nut and the saddle of the instrument, and of course the performance or playing of the instrument. The overall structure of the instrument effects the manner in which the strings vibrate and therefore the sound produced. Similar considerations thus apply to conventional "electrified" acoustic guitars as apply to "electric" guitars, which may be solid and may not have a resonant cavity.

For an acoustic guitar, however, it is the soundboard or face of the instrument, the back and then the sides that are predominantly heard "acoustically", i.e. without piezoelectric sensors or without power applied to them. These components of the resonant cavity vibrate in sympathy with the strings and, in turn, cause vibrations in the surrounding air. The sound or "character" of the instrument thus arises as a consequence of the construction of the instrument.

Since the piezoelectric sensors in under saddle systems are not in intimate contact with these other resonant components of the instrument, the vibrations of these other components are not reproduced to any significant extent.

Also, piezoelectric sensors that are commercially available, and used in most existing electronic amplification systems, are considered "metallic" in sound, are prone to emphasize the high frequencies and are consequently considered unrealistic in their sound reproduction, at least to some degree. Piezoelectric systems are thus not consistent with the "natural sound" (as heard acoustically), or at least the sound as recorded by means of a microphone placed in front of the instrument.

Inevitably, any comparisons of amplification systems are of a highly non-specific or of a subjective nature: different guitars, studios, equipment, players and so on being involved.

The sound actually heard during an acoustic guitar performance is also dependent on the environment in which the instrument is played as that environment has its own characteristic reverberation or reflections.

Whilst most musicians and recording engineers agree that systems using piezoelectric sensors (to produce the initial electrical output) deliver a palatable result, or an aesthetic result, it is a very different sound to that produced by the guitar when heard acoustically, or the sound recorded by a microphone placed in front of the instrument.

Using a microphone to amplify or record an acoustic guitar may produce a more realistic sound but this method of reproduction also has inherent limitations, particularly in a real performance space. Sources of sound other than the intended source, being the guitar, are also detected by the microphone and amplified and/or recorded. This is clearly undesirable.

There have in the past been attempts to produce a more realistic amplified sound of an acoustic guitar by directly sensing vibrations in the soundboard or face of the instrument. However, such attempts have met with limited success because they have so far failed to produce a sound that is any more realistic than under saddle systems. The sound of these systems is different to that produced by under saddle systems but is no more convincing.

There therefore remains a need for a device or system which receives input signals directly from sensors placed in or on the instrument and uses these signals to produce a more realistic or natural sound than has presently been achieved.

Any discussion of documents, devices, acts or knowledge in this specification is included to explain the context of the invention. It should not be taken as an admission that any of the material formed part of the prior art base or the common general knowledge in the relevant art in Australia or any other country on or before the priority date of the claims herein.

SUMMARY OF THE INVENTION

The present inventor has found that lower frequencies of the audio spectrum, as heard by an observer within a performance space, are not well represented or reproduced by sensors attached to the soundboard of an instrument. The inventor believes this may be because the lower frequencies are generated over a large area of the instrument whilst soundboard sensors are necessarily in contact with only a limited area. On the other hand, the inventor has found that the lower frequencies are clear and well represented by under saddle sensors. This led to the proposition that a combination of sensors, each directed to a different range of frequencies, would more accurately represent the sound normally heard by a listener during an acoustic performance of an instrument such as a guitar.

The present invention thus resides in a recognition that it is possible to use a combination of sensors to detect different parts of the audio frequency spectrum from different parts of an instrument. In one embodiment, lower frequencies are taken from an under saddle sensor and higher frequencies are taken from a sensor situated on the soundboard or face of the instrument.

This outcome has been achieved in this embodiment by filtering, or "rolling off", the higher frequencies from the under saddle sensor(s) and, conversely, filtering the lower frequencies from the soundboard sensor so that only the "top end", or frequencies not produced by the under saddle sensor, are transmitted. Thus, the under saddle sensor produces the lower, or "bottom end", frequencies whilst the soundboard sensor produces the higher, or "top end", frequencies. A suitable crossover circuit may be employed to mix the two frequency ranges to produce a uniform combined frequency response.

One aspect of the invention accordingly provides a device for mixing the outputs of two sensors including:

a first input for receiving a signal from at least one first sensor;

a second input for receiving a signal from at least one second sensor;

a low pass filter for passing signal components of the first input signal below a first frequency;

a high pass filter for passing signal components of the second input signal above a second frequency; and a mixing circuit for combining the signals passed by the low pass filter and the high pass filter to form a combined output signal.

The first frequency may define the corner frequency of the low pass filter and the second frequency may define the corner frequency of the high pass filter. There may therefore exist a crossover between the input signals from the first and second sensors at a crossover frequency determined by the corner frequencies of the two filters. The first and second corner frequencies are preferably selected to provide a substantially uniform overall response in the combined output signal.

In one embodiment the device includes a control means for varying the first frequency, i.e. the corner frequency of the low pass filter. Preferably, the variable first frequency has a minimum value substantially equal to the second frequency, i.e. the corner frequency of the high pass filer. The minimum value of the first frequency is preferably set within the range of 300 Hz to 900 Hz and most preferably at about 750 Hz, although any alternative frequency may be selected.

In one embodiment the first frequency is variable between the minimum frequency and 10 kHz.

In one embodiment the control means also includes an attenuator for varying the level of the signal passed by the high pass filter from the second input to the mixing circuit.

In a preferred embodiment, the control means simultaneously varies the first frequency of the low pass filter and varies the level of the signal passed by the high pass filter. Preferably, the range of frequencies passed by the low pass filter is extended at the same time as the level of the signal passed by the high pass filter is attenuated, i.e. reduced. Conversely, the range of frequencies passed by the low pass filter is preferably reduced whilst the level of the signal passed by the high pass filter is increased.

In one embodiment the second corner frequency is set within the range of 300 Hz to 900 Hz and most preferably at about 750 Hz, although any alternative corner frequency may be selected Another aspect of the invention provides a pre-amplifier incorporating a mixing device as described above. Such a pre-amplifier may be used with, or built within, an acoustic guitar. An under saddle sensor may be connected to the first input of the mixing device and a second sensor attached to a body portion of the guitar, such as the inside of the soundboard of the guitar, may be connected to the second input of the device. In this way, lower frequencies are taken from the under saddle sensor and higher frequencies are taken from the soundboard sensor.

Another aspect of the invention provides an acoustic guitar including an under saddle sensor, a soundboard sensor and a pre-amplifier as described above. The pre-amplifier may be made to be sufficiently small to be contained within the resonant cavity of the guitar with only a control knob or slider of the control means being visible. In this way, the guitar looks, externally, like any other acoustic guitar and the musician can control the mix, or proportion, of the output signal sourced from the under saddle sensor and the soundboard sensor.

In a preferred embodiment, three or more sensors may be used to produce a fuller, and even more realistic, sound. In this embodiment an under saddle sensor is connected to the first input of the mixing device, so as to reproduce the lower frequencies, and two sensors, attached to two separate body portions of the guitar, may be connected to the second input of the mixing device, so as to reproduce the higher frequencies based on a combination of these body sensors.

One of the body sensors may be attached to the soundboard of the guitar and the other may be attached to its rear panel, or any other suitable portion of the body of the instrument as may be determined by trial and error for best and most realistic sound reproduction.

The body sensors may be simply connected in parallel and then to the second input of the mixing device or they may be connected via a potentiometer much in the same way as a conventional balance control. Thus, the potentiometer may determine the mix between the body sensors, which is then supplied to the second input of the mixing device.

It will be appreciated that a greater number of sensors may also be employed in various combinations.

The soundboard sensor used with the present invention may be of any suitable type but is preferably of the type described in the inventor's earlier Australian patent No. 632064 (application No. 43019/89).

To assist the further understanding of the invention, reference is now made to the accompanying drawings which illustrate a preferred embodiment. It is to be appreciated, however, that this embodiment is given by way of illustration only and the invention is not to be limited by this illustration.

DETAILED DESCRIPTION OF THE DRAWINGS

Figure 1:
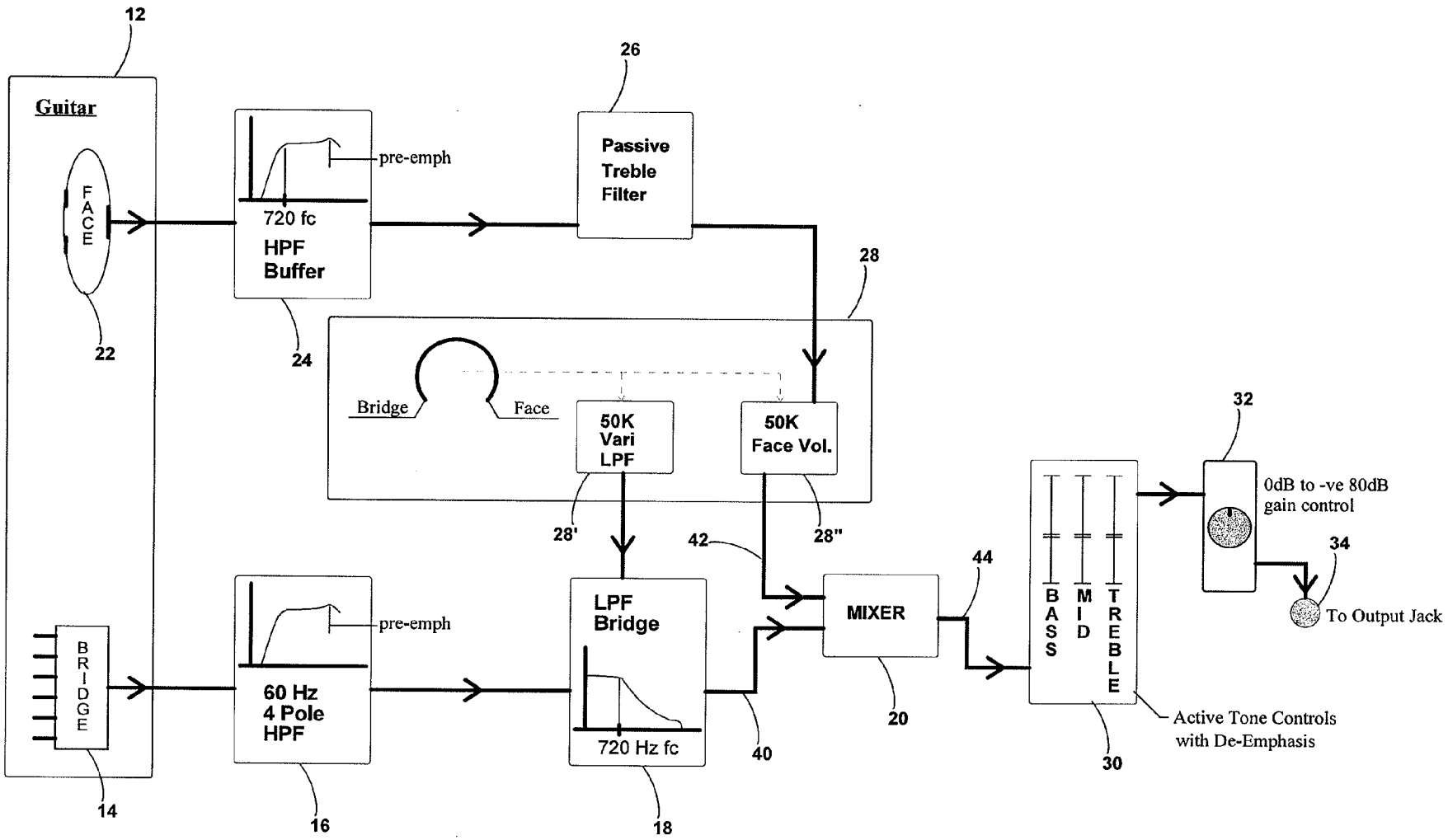
FIG. 1 shows a functional block diagram of a pre-amplifier system for electronic amplification or recording of an acoustic guitar.

Referring now to FIG. 1, there is shown a system 10 for recording or amplifying a stringed instrument such as an acoustic guitar 12. The system includes a first input for an under saddle sensor 14 (which may be of a conventional type) connected to a buffer and pre-emphasis circuit 16. The circuit 16 also provides, in this embodiment, power gain and low frequency filtering below about 60 Hz. The signal is then fed to a variable frequency low pass filter 18, the corner frequency of which is preferably variable between about 720 Hz and 10 kHz. The minimum corner frequency of the low pass filter corresponds to a fixed corner frequency of the high pass filter 24 described below. The output of the low pass filter 16 is then fed to a mixing circuit 20.

The system also includes a second input for a soundboard sensor 22 connected to a high pass filter 24. In this embodiment the high pass filter 24 also includes a buffer, power gain and pre-emphasis circuit. In this embodiment the high pass filter 24 has a fixed corner frequency of about 720 Hz, corresponding to the minimum corner frequency of the low pass filter 18. The lowest crossover frequency between the sensors 22,14 connected to the high pass filter 24 and low pass filter 18 is therefore 720 Hz in this instance. When the corner frequency of the low pass filter 18 is increased, the effective crossover frequency between the two sensors is increased. A passive treble roll-off filter 26 may also be provided to restrict the highest frequency passed to the mixer 20.

A control means in the form of a dual gang potentiometer 28 is provided to control the blend of signals from the under saddle sensor 14 and soundboard sensor 22. The potentiometer may be of a rotary type or of a linear slider type, as is often used for electric guitar tone controls. In this instance, the dual gang potentiometer 28 includes two elements 28' and 28" to simultaneously control the corner frequency of the low pass filter 18 and the level of the signal from the high pass filter 24.

The system shown in FIG. 1 also Includes tone controls 30 including bass, mid and treble controls, however tone controls optional. Similarly, a gain control 32 is shown in FIG. 1 but, once again, this control is not essential. The output signal is then provided to an output jack 34 which typically would be provided in a side wall of the guitar.

Details of the variable low pass filter 18 and fixed high pass filter 24 have been omitted from this description because it is considered to be well within the ability of any reasonably skilled person in the art to construct these filters using conventional techniques based on the information provided in FIG. 1 and the frequency response curves provided in FIG. 2A to 2D. Similarly, it is considered well within the ability of any reasonably skilled person in the art to construct a suitable mixer circuit 20 for combining the signals from the high pass and low pass filters. Thus, these circuits do not need to be described herein in detail.

Turning now to FIGS. 2A to 2D, there are shown a number of frequency response curves with varying blends of signals provided by the under saddle sensor 14 and soundboard sensor 22. The curves are derived from actual test results for a prototype unit and are not necessarily theoretically ideal. Further enhancement may be possible.

Each figure includes a first curve representing a signal 40 derived from the under saddle sensor 14 at the output of the low pass filter 18. A second curve represents a signal 42 derived from the soundboard sensor 22 following the high pass filter 24 and attenuation via the potentiometer 28". A third curve represents the combined signal 44 produced at the output of the mixer 20.

It can be seen that as the potentiometer 28 is panned from 0% (FIG. 2A) to 50% (FIG. 2B) the level of the signal 42 provided by the soundboard sensor 22 increases. Further increases occur as the potentiometer 28 is panned to 70% (FIG. 2C) and then to 100% (FIG. 2D).

Figure 2A:
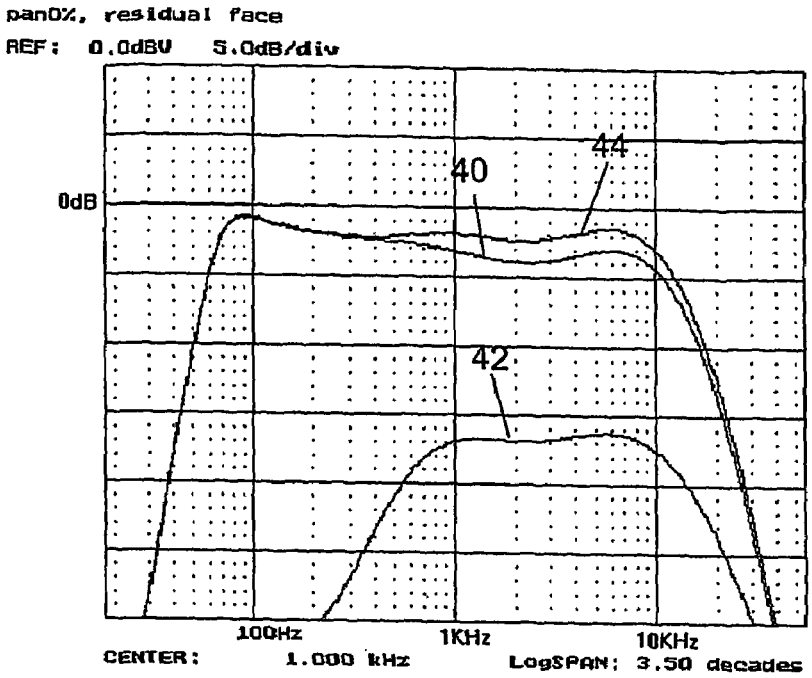
FIGS. 2A to 2D show a number of graphs giving frequency response curves derived from test results of a prototype system according to the diagram shown in FIG. 1. These figures show adjustment of the signal mix, entirely from the under saddle sensor (pan=0%), and increasing amounts of higher frequencies from the soundboard sensor being introduced (pan=50%, 70% and 100%).
Figure 2B:
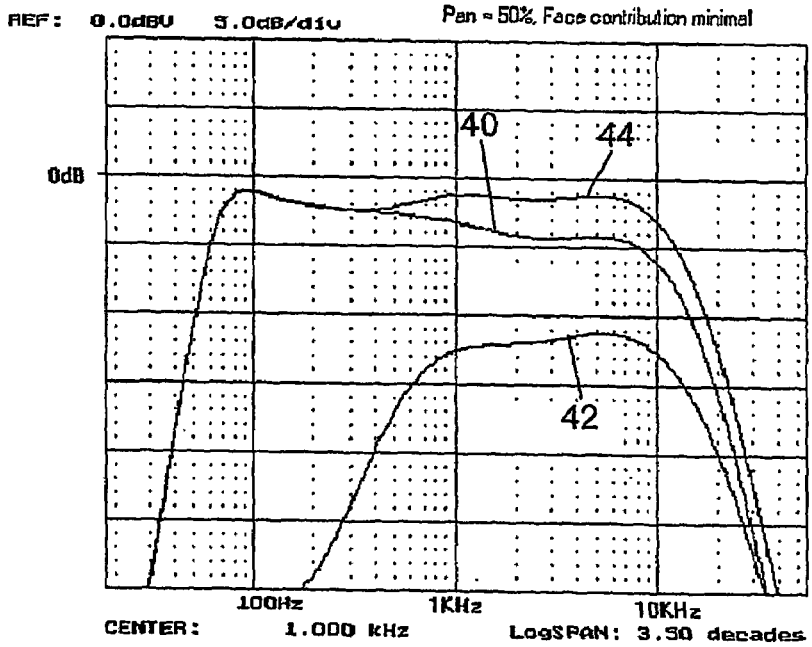
Figure 2C:
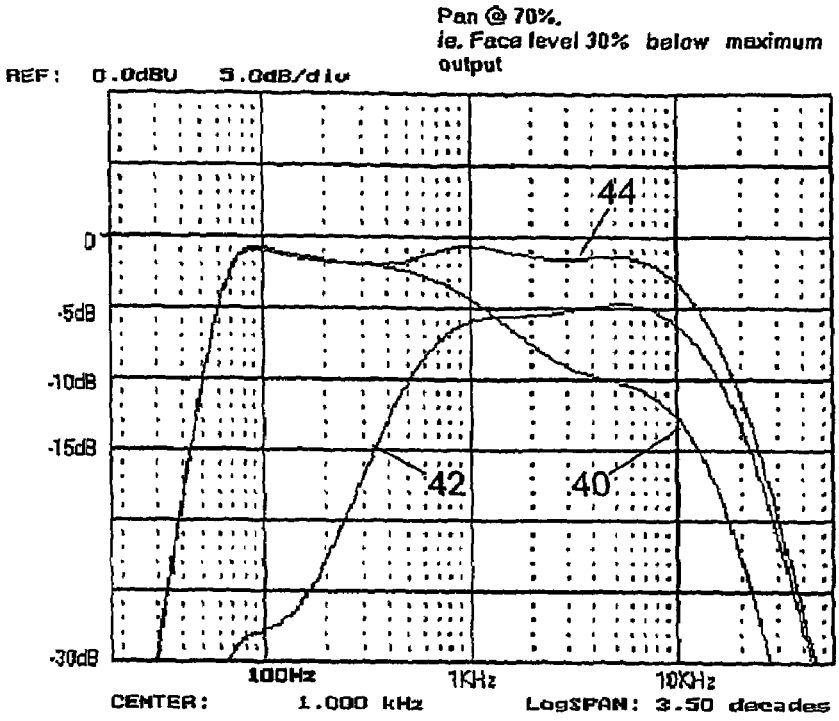
Figure 2D:
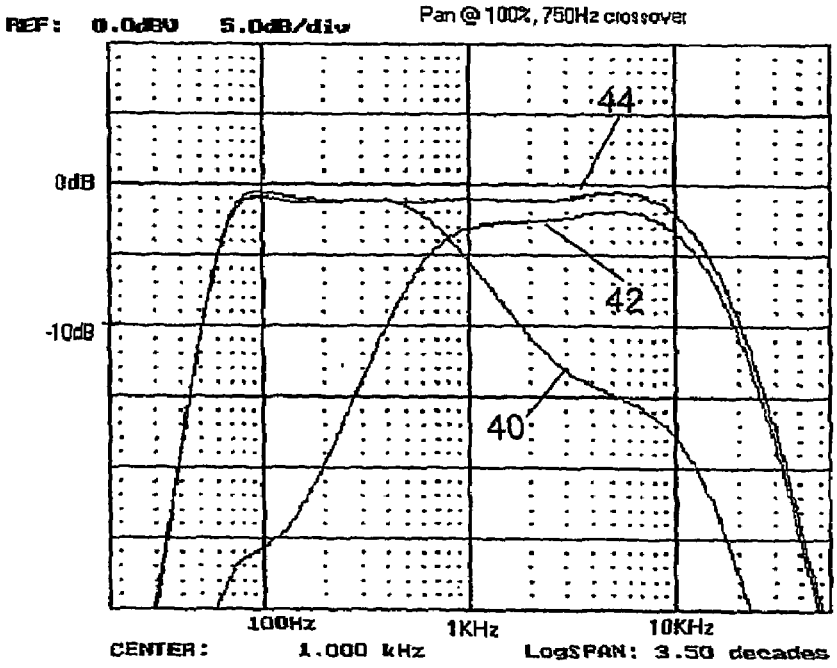

At the same time, the corner frequency of the low pass filter 18 is gradually reduced as one moves from pan=0% (FIG. 2A) through to pan=100% (FIG. 2D).

These actions occur simultaneously such that the output signal 44 is maintained at a constant level throughout the frequency range of interest (roughly 70 Hz to 10 KHz It must be appreciated that the crossover frequency is arbitrary and has presently been chosen by the inventor to be around 720 to 750 Hz so as to produce what is considered to be the most realistic or natural sound. Test results have shown that the prototype crossover function provides a level output within +/−0.5 dB, within the area of interest (the pass band), the qualifier being that the blend control is set to maximum soundboard signal (pan=100%). When the blend control is set to maximize the signal from the under saddle sensor (pan=0%) the frequency response is flat with only a residual signal being supplied by the soundboard sensor on the soundboard, the balance of the output signal being the full frequency range supplied by the under saddle sensor. If the blend control is put at the other extremity (pan=100% as shown in FIG. 2D), the output signal comprises two equal level mixed signals:

a) the soundboard sensor supplies signals ranging from well below 750 Hz to above 15 kHz, and b) the under saddle sensor provides the lower range signals, from below 60 Hz to well above 750 Hz.

The ratio of these blended signals at the common frequencies above/below the respective crossover points is the key to the very smooth overall blended frequency response. These roll-off curves are nominally 10 dB per octave for the soundboard sensor and 5.5 dB per octave for the under saddle sensor.

As the blend control 28 is pushed to any point in between the two extremities the variable low pass filter for the under saddle sensor determines the range of frequencies above 750 Hz fed to the mixer 20. Conversely, the blend control 28 also determines the complimentary soundboard sensor signal level fed into the mixer 20.

Regardless of the blend setting, other than at full soundboard blend, the frequency response is held within +/−2 dB. This "tracking" level is achieved without the need for a special "curve" on the dual gang potentiometer 28 used for the blend control.

Although a preferred embodiment of the invention has been described herein in detail, it will be understood by those skilled in the art that variations may be made thereto without departing from the spirit or scope of the invention. For example, in the embodiment described, the corner frequency of the high pass filter is fixed. This need not be the case and may instead be variable, in a manner similar to the variable control of the corner frequency of the low pass filter. Also, in this instance, the level of the signal from the high pass filter may be fixed rather than variable, with blend control being achieved by simultaneous variation of the two filter corner frequencies

The invention claimed is:

1. A device for mixing the outputs of two sensors attached to a stringed musical instrument, the device including:

a first input for receiving a signal from an under saddle sensor;

a second input for receiving a signal from a sensor attached to a body portion of the instrument;

a low pass filter for passing signal components from the under saddle sensor below a first frequency;

a high pass filter for passing signal components from the body sensor above a second frequency;

a mixing circuit for combining the signals passed by the low pass filter and the high pass filter to form a combined output signal; and control means for enabling a user to simultaneously vary the first frequency of the low pass filter and vary a level of the signal passed by the high pass filter.

2. A device according to claim 1 wherein the first frequency defines a corner frequency of the low pass filter and the second frequency defines a corner frequency of the high pass filter.

3. A device according to claim 2 wherein there exists a crossover between the input signals from the first and second sensors at a crossover frequency determined by the corner frequencies of the two filters.

4. A device according to claim 3 wherein the first and second corner frequencies are selected to provide a substantially uniform overall response in the combined output signal.

5. A device according to claim 4 wherein the variable first frequency has a minimum value substantially equal to the second frequency.

6. A device according to claim 5 wherein the first frequency has a minimum value within the range of 300 Hz to 900 Hz.

7. A device according to claim 6 wherein the minimum value is about 750 Hz.

8. A device according to claim 6 wherein the first frequency is variable between the minimum value and about 10 kHz.

9. A device according to claim 4 wherein the control means further includes an attenuator for varying the level of the signal passed by the high pass filter from the second input to the mixing circuit.

10. A device according to claim 1 wherein the range of frequencies passed by the low pass filter is extended whilst the level of the signal passed by the high pass filter is attenuated, and the range of frequencies passed by the low pass filter is reduced whilst the level of the signal passed by the high pass filter is increased.

11. A device according to claim 1 wherein the second frequency is within the range of 300 Hz to 900 Hz.

12. A device according to claim 11 wherein the second frequency is about 750 Hz.

13. A pre-amplifier incorporating a mixing device according claim 1.

14. A pre-amplifier according to claim 13 wherein the second sensor is attached to the inside of the soundboard of the musical instrument.

15. An acoustic guitar including an under saddle sensor, a second sensor attached to a body portion of the guitar and a pre-amplifier according to claim 13 wherein the under saddle sensor in connected to the first input of the mixing device and the second sensor is connected to the second input of the mixing device.

16. An acoustic guitar according to claim 15 wherein the second sensor is attached to the inside of the soundboard of the guitar.

17. An acoustic guitar according to claim 15 wherein a further sensor is attached to another body portion of the guitar and is also connected to the second input of the mixing device.

18. An acoustic guitar according to claim 17 wherein the second sensor is attached to the soundboard of the guitar and the further sensor is attached to the rear panel of the guitar.

* * * * *